US006776141B2

(12) United States Patent
Hamada et al.

(10) Patent No.: US 6,776,141 B2
(45) Date of Patent: Aug. 17, 2004

(54) FUEL SUPPLY APPARATUS FOR ENGINES

(75) Inventors: Mikio Hamada, Obu (JP); Satomi Wada, Obu (JP)

(73) Assignee: Aisan Kogyo Kabushiki Kaisha, Obu (JP)

( * ) Notice: Subject to any disclaimer, the term of this patent is extended or adjusted under 35 U.S.C. 154(b) by 0 days.

(21) Appl. No.: 10/752,722

(22) Filed: Jan. 8, 2004

(65) Prior Publication Data

US 2004/0139946 A1 Jul. 22, 2004

(30) Foreign Application Priority Data

Jan. 16, 2003 (JP) ..... 2003-008335

(51) Int. Cl.[7] ..... F02M 41/00
(52) U.S. Cl. ..... 123/458; 123/497
(58) Field of Search ..... 123/458, 497, 123/509, 499, 456, 457, 510, 514

(56) References Cited

U.S. PATENT DOCUMENTS 5,425,342 A * 6/1995 Ariga et al. ..... 123/456
6,065,436 A * 5/2000 Koga et al. ..... 123/179.17
6,453,878 B1 * 9/2002 Mazet ..... 123/497
6,712,044 B1 * 3/2004 Rembold et al. ..... 123/456
6,718,948 B2 * 4/2004 Vahle et al. ..... 123/458

FOREIGN PATENT DOCUMENTS

| | | |
|---|---|---|
| JP | A 10-89184 | 4/1998 |
| JP | B2 3196656 | 6/2001 |
| JP | B2 3228145 | 9/2001 |

* cited by examiner

*Primary Examiner*—Mahmoud Gimie
(74) *Attorney, Agent, or Firm*—Oliff & Berridge, PLC

(57) ABSTRACT

A fuel supply apparatus is adapted to control a pump which discharges fuel from a tank to a fuel passage, thereby regulating the pressure of fuel to be supplied to an engine. The tank includes a plurality of storage chambers, in a specific one of which the pump is placed. A part of the fuel discharged to the fuel passage is returned to the specific storage chamber through a branch passage. A storage chamber other than the specific storage chamber is in communication with the branch passage through a communication passage. A jet pump is operated to transfer the fuel from the storage chamber other than the specific storage chamber to the specific storage chamber through the communication passage by the action of the fuel flowing through the branch passage. An electronic control unit (ECU) controls an electromagnetic valve disposed in the branch passage to regulate the quantity of return flow, thereby delivering the fuel in a quantity corresponding to a consumption quantity of fuel to be sequentially consumed in the engine, to the engine through the communication passage.

20 Claims, 7 Drawing Sheets

FUEL SUPPLY APPARATUS FOR ENGINES

BACKGROUND OF THE INVENTION

1. Field of the Invention

The present invention relates to a fuel supply apparatus for engines, which discharges fuel from a fuel tank by a fuel pump and controls the fuel pump to regulate pressure of the fuel.

2. Description of Related Art

One of the fuel supply apparatuses of the above type is disclosed in Japanese patent unexamined publication No. HEI 10-89184 (Patent Literature 1), on pages 2–9 and FIGS. 2–5. This fuel supply apparatus is designed to supply fuel from a fuel tank to a delivery pipe and injectors of an engine through a fuel pump and a fuel line. In this apparatus, the fuel pump is controlled by an electronic control unit (ECU) so that the pressure of fuel to be supplied to the injectors becomes the target pressure responsive to an operating state of the engine. This apparatus is not constructed to return the remaining fuel, which has been not injected through the injectors, to the fuel tank through the delivery pipe and hence it is not provided with a generally used return line and pressure regulator. Thus, the apparatus can have a simplified piping configuration.

Furthermore, the fuel tank of the above apparatus is shaped like a saddle having a concave portion opening into an underside so that the tank mounted in a vehicle does not interfere with a propeller shaft (not shown) or the like. The fuel tank is partitioned into a first and second storage chambers by the concave portion. The fuel pump is placed in only the first storage chamber and therefore cannot directly pump and discharge the fuel from the second storage chamber. This apparatus is accordingly provided with a branch passage through which a part of the fuel pumped from the first storage chamber by the fuel pump to be discharged into the fuel line is returned to the first storage chamber. On the branch passage ar disposed an electromagnetic valve for opening and closing the branch passage and a jet pump for letting fuel through the branch passage to produce a negative pressure in the branch passage. A communication passage is provided between the jet pump and the second storage chamber, providing a fluid communication therebetween. Accordingly, when the electromagnetic valve is opened, a part of the fuel discharged by the fuel pump is returned to the first storage chamber through the branch passage. When this return fuel passes through the jet pump, a negative pressure is formed in the pump. By the suction power resulting from the negative pressure, the fuel in the second storage chamber is transferred to the first storage chamber through the communication passage. In this apparatus, the electromagnetic valve of a normally opened type is controlled by the ECU to close in response to the operating state of the engine. For example, under acceleration when the engine demands a larger quantity of fuel (a target fuel pressure increases), the electromagnetic valve is closed upon energization, blocking the branch passage. Thus, the flow of fuel is stopped in the branch passage, so that the fuel pressure being supplied to the injectors increases by just that much.

Japanese patent publication No. 3,196,656 (Patent Literature 2) discloses, on pages 2–6 and FIGS. 2–4, a fuel supply apparatus including a mechanical structure identical to that of the fuel supply apparatus described in the patent literature 1. Moreover, Japanese patent publication No. 3,228,146 (Patent Literature 3) discloses, on pages 7–8 and FIG. 7, a fuel supply apparatus including a similar structure to those of the fuel supply apparatuses disclosed in the patent literatures 1 and 2. The fuel supply apparatus in the patent literature 3 uses a relief valve instead of the electromagnetic valve in the patent literatures 1 and 2.

In the fuel supply apparatus in the patent literature 1, when the quantity of fuel is reduced for deceleration of an engine or when the engine demands a relatively smaller quantity of fuel, the electromagnetic valve is opened to return the surplus fuel to the first storage chamber through the branch passage and the jet pump. At this time, the jet pump pumps the fuel from the second storage chamber to transfer the fuel to the first storage chamber.

In the fuel supply apparatus disclosed in the patent literature 2, when the engine increased in temperature is stopped, the electromagnetic valve is opened while the fuel pressure in the fuel line and the delivery pipe is increasing, thereby returning the fuel to the first storage chamber through the branch passage and the jet pump. At this time, the jet pump is also operated to pump the fuel from the second storage chamber into the first storage chamber.

In the fuel supply apparatus disclosed In the patent literature 8, when the pressure of fuel to be discharged by the fuel pump into the fuel line exceeds a setting pressure value, the relief valve is opened to return the fuel to the first storage chamber through the branch passage (the relief passage) and the jet pump. At this time, the fuel pressure in the fuel line decreases and simultaneously the fuel is pumped from the second storage chamber by suction power of the jet pump and transferred to the first storage chamber.

In the fuel supply apparatuses in the above patent literatures 1–3, the flow quantity of fuel to be transferred (a transfer flow quantity) from the second storage chamber to the first storage chamber depends on the quantity of fuel (a surplus flow quantity) flowing from the fuel line to the branch passage. This surplus flow quantity is determined by a difference between the quantity of fuel discharged from the fuel pump and the quantity of fuel injected from the injectors. The difference is unstable and sometimes excessive. If the surplus flow quantity becomes excessive, accordingly, the transfer flow quantity will become excessive. Thus, an excessive quantity of fuel may be returned from the jet pump to the first storage chamber, with a consequent fear that the fluid level of fuel in the first storage chamber is so undulated as to generate a large quantity of fuel vapors.

SUMMARY OF THE INVENTION

The present invention has been made in view of the above circumstances and has an object to overcome the above problems and to provide a fuel supply apparatus for engines, capable of preventing the generation of a large quantity of fuel vapors during fuel transfer from a storage chamber to a specific storage chamber.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the purpose of the invention, there is provided a fuel supply apparatus comprising: a fuel tank for storing fuel, including a plurality of storage chambers one of which is a specific storage chamber; a fuel pump, placed in the specific storage chamber, for discharging the fuel from the fuel tank into a fuel passage which is communicated with an engine, the fuel pump being controlled to regulate pressure of the fuel which is to be supplied to the engine; a branch passage branching off of the fuel passage, through which branch passage a part of the fuel discharged by the fuel pump is returned to the specific storage chamber; a communication passage which provides communication between a storage chamber other than the specific storage chamber and the branch passage; transfer means for transferring the fuel from the storage chamber other than the specific storage chamber to the specific storage chamber through the communication passage by action of the fuel flowing through the branch passage; flow regulation means for regulating a flow quantity of fuel in the branch passage; fuel consumption calculation means for calculating a quantity of fuel to be sequentially consumed in the engine; and flow regulation control means for controlling the flow regulation means to transfer fuel in a quantity corresponding to the fuel consumption quantity calculated by the fuel consumption calculation means, from the storage chamber other than the specific storage chamber to the specific storage chamber through the communication passage.

According to another aspect, the present invention provides a fuel supply apparatus comprising: a fuel tank for storing fuel, including a plurality of storage chambers one of which is a specific storage chamber; a fuel pump, placed in the specific storage chamber, for discharging the fuel from the fuel tank into a fuel passage which is communicated with an engine including a plurality of cylinders, the fuel pump being controlled to regulate pressure of the fuel which is to be supplied to the engine; injectors for supplying the fuel, delivered thereto through the fuel passage, into respective associated cylinders; a branch passage branching off of the fuel passage, through which branch passage a part of the fuel discharged by the fuel pump is returned to the specific storage chamber; a communication passage which provides communication between a storage chamber other than the specific chamber and the branch passage; a jet pump for transferring the fuel from the storage chamber other than the specific storage chamber to the specific storage chamber through the communication passage by action of the fuel flowing through the branch passage, the jet pump including: a restricted portion for restricting a flow quantity of fuel in the branch passage; and a discharge port through which the fuel having passed through the restricted portion is discharged, the restricted portion being adapted to increase a flow velocity of the fuel passing through the restricted portion, producing a negative pressure in the restricted portion and a consequent suction power, so that the fuel is sucked from the storage chamber other than the specific storage chamber and transferred into the specific chamber through the communication passage and the discharge port; an electromagnetic valve for regulating the flow quantity of fuel in the branch passage, the electromagnetic valve including a valve body and energization of the electromagnetic valve being controlled to reciprocate the valve body between a full open position and a full closed position; fuel consumption calculation means for calculating a quantity of fuel to be sequentially consumed in the engine; and flow regulation control means for controlling the flow regulation means to transfer fuel in a quantity corresponding to the fuel consumption quantity calculated by the fuel consumption calculation means, from the storage chamber other than the specific storage chamber to the specific storage chamber through the communication passage, the now regulation control means calculating an energization time of the electromagnetic valve based on the fuel consumption quantity calculated by the fuel consumption calculation means and, based on the calculated energization time, operates the electromagnetic valve under a duty control at a predetermined cycle.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings.

DETAILED DESCRIPTION OF THE PREFERRED EMBODIMENTS

[First embodiment]

A detailed description of a first preferred embodiment of a fuel supply apparatus for engines, embodying the present invention will now be given referring to the accompanying drawings.

Figure 1:
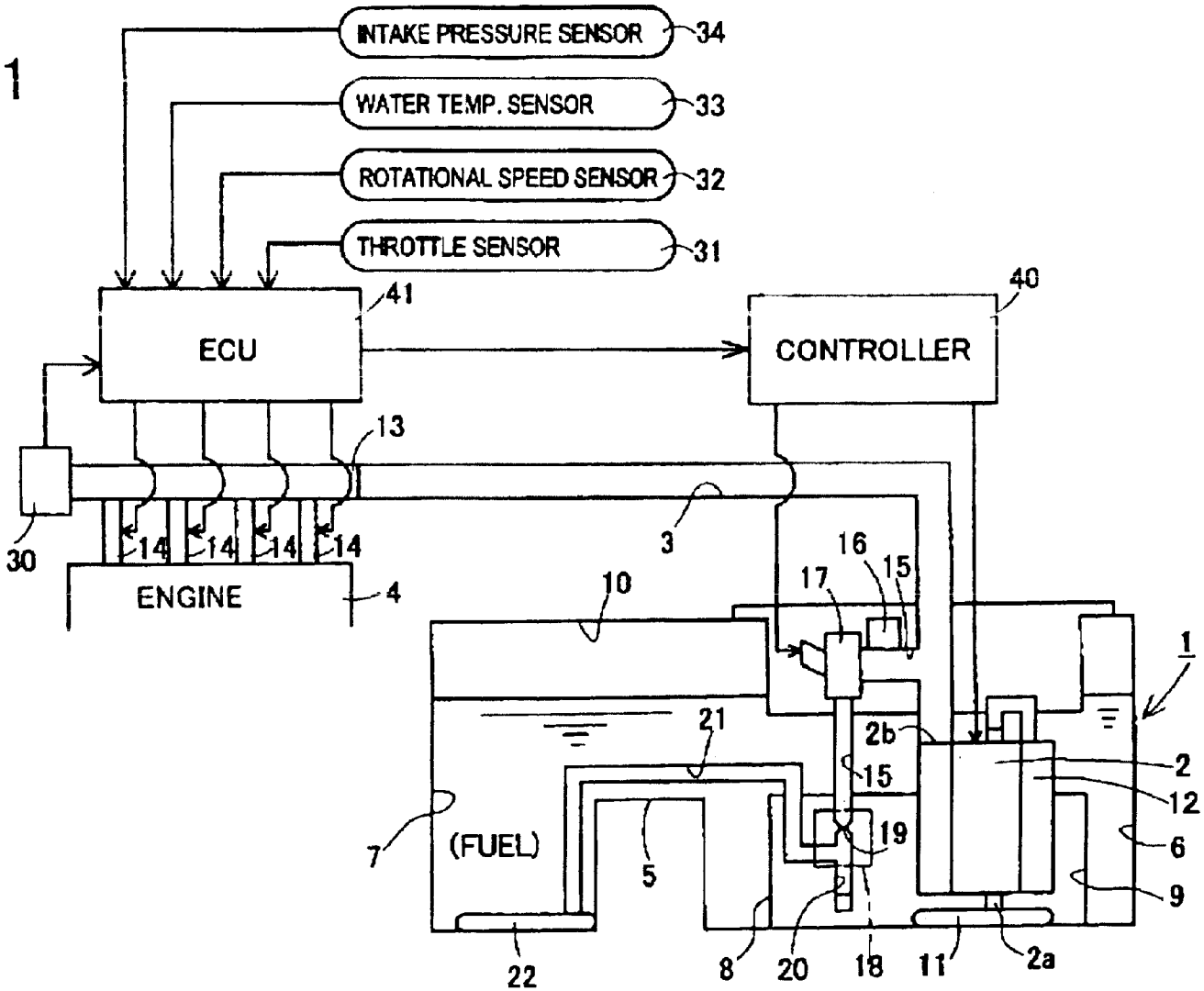
FIG. 1 is a schematic structural view of the fuel supply apparatus in a first embodiment.

FIG. 1 shows a schematic structural view of the fuel supply apparatus in the present embodiment. This apparatus is adapted to pump the fuel stored in a fuel tank 1 by means of a fuel pump 2 and discharge the fuel into a fuel line 3 serving as a fuel passage. The fuel pump 2 is controlled to regulate the pressure of fuel which is to be supplied to an engine 4 through the fuel line 3.

In the present embodiment, the fuel tank 1 is of saddle shape having a tunnel-like concave portion 5 opening into an underside of the tank 1. The tank 1 is divided into a first storage chamber 6 and a second storage chamber 7 by the concave portion 5. In the first storage chamber 6 placed is a reserve tank 9 defined by a partition wall 8. This reserve tank 9 corresponds to a specific storage chamber of the invention. The first and second storage chambers 6 and 7 correspond to storage chambers of the invention other than the specific chamber. These two storage chambers 6 and 7 are in communication with each other through a communication chamber 10 above the concave portion 5. The fuel tank 1 with the concave portion 5 is mounted in a vehicle, straddling driveling components such as a propeller shaft and exhaust components such as an exhaust pipe to prevent interference with those components. When the fluid level of the fuel in the fuel tan 1 of saddle shape becomes lower than the bottom wall of the concave portion 5, the stored fuel is separated into the two storage chambers 6 and 7. In addition, the fuel in the first storage chamber 6 is separated into the inside and outside of the reserve tank 9.

The fuel pump 2 is placed within the first storage chamber 6, only in the reserve tank 9. This fuel pump 2 is an electric motor-driven type constituted of a motor and an impeller which is driven by the motor, both not shown. The quantity of fuel to be discharged by the fuel pump 2 is determined based on a rotational speed of the impeller driven by the motor. In other words, the fuel discharge rate by the fuel pump 2 is determined based on a value of electric current or voltage supplied to tho motor.

Figure 2:
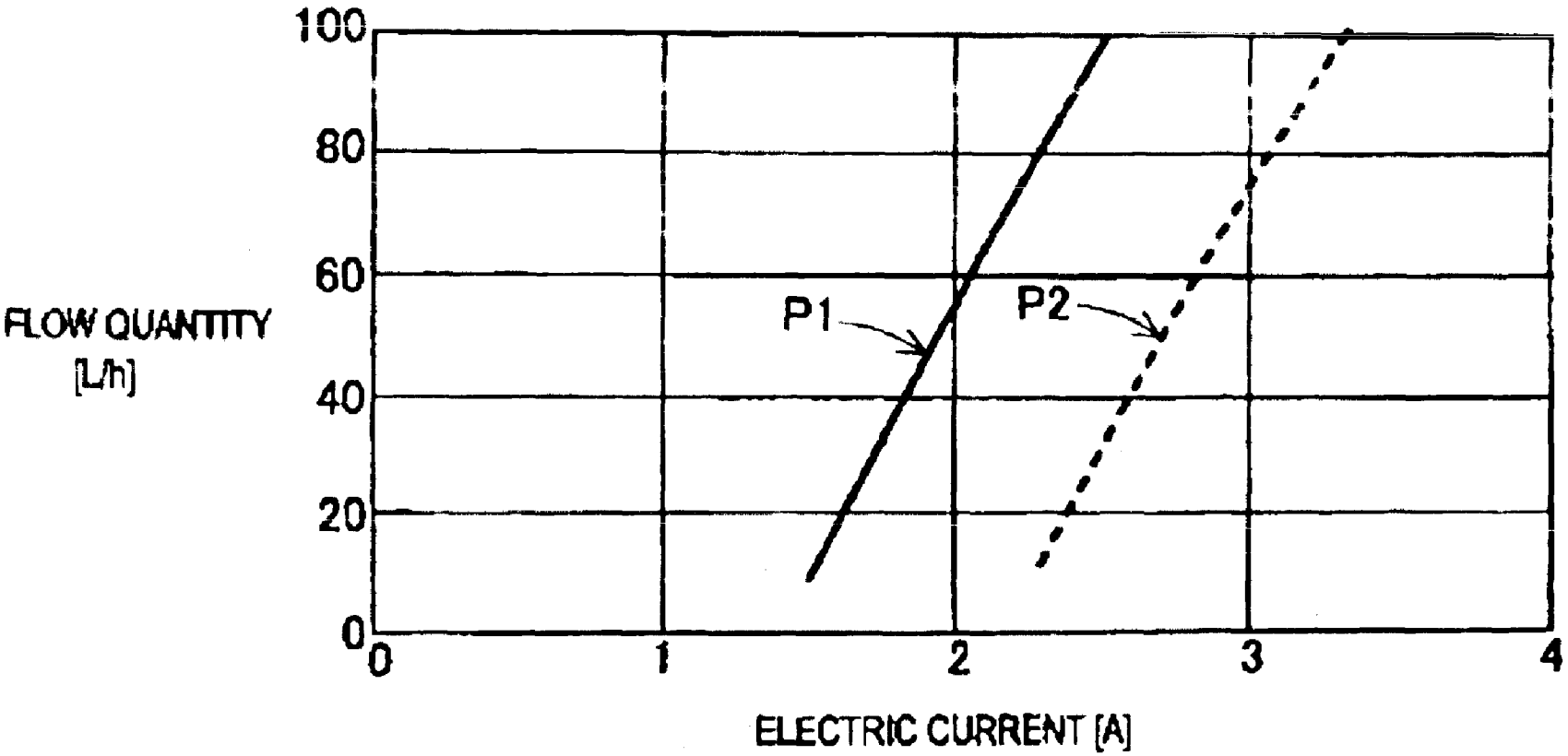
FIG. 2 is a graph showing a flow characteristic of a fuel pump.

FIG. 2 shows a graph of a flow characteristic of the fuel pump 2. In this graph, the lateral axis indicates the electric current to be supplied to the motor and the vertical axis indicates the flow quantity of fuel to be discharged by the fuel pump 2, as parameters respectively. This graph shows the flow characteristic related to two different fuel pressures P1 and P2. For example, it is herein assumed that the pressures P1 and P2 are 200 kPa and 300 kPa respectively. The lateral axis may represent voltage or control value (duty ratio) instead of the electric current.

The fuel pump 2 has an intake port 2*a* attached with a suction filter 11 for removing foreign materials. A filter 12 for purifying fuel is circumferentially fit on the fuel pump 2. The fuel line 8, which is connected at one end with a discharge port 2*b* of the fuel pump 2, extends passing through an upper cover of the fuel tank 2 to the outside and is connected at the other end with a fuel rail (a delivery pipe) 13 arranged near the engine 4. A plurality of injectors 14 provided in the delivery pipe 13 are positioned in correspondence with associated cylinders of the engine 4. In the present embodiment, the four-cylinder engine 4 is provided with four injectors 14. Each injector 14, which is an injection valve with a well known electromagnetic valve, is opened upon energization. The engine 4 is provided with an intake passage and an exhaust passage (both not shown). At one end of the delivery pipe 13, a fuel pressure sensor 30 is provided for detecting the pressure of fuel to be supplied to the pipe 13.

In the fuel line 3 just behind the discharge port 2*b* of the fuel pump 2, there is provided a branch passage 16 branching off of the fuel line 3 to return a part of the fuel discharged by the fuel pump 2 into the reserve tank 9 placed in the first storage chamber 6. A relief valve 16, an electromagnetic valve 17, and a jet pump 18 are arranged in the branch passage 15. When energized, the electromagnetic valve 17 operates its valve body. In general, there are two types of general electromagnetic valves; one designed to open upon energization and the other designed to close upon energization. In the present embodiment, in view of safety and reduction in heating value, the former type of an electromagnetic valve which is opened upon energization is preferably employed, but not limited thereto. As a method to energize the electromagnetic valve 17, one of so-called "Duty Controls" is used. Specifically, this is the method that energization and non-energization of the electromagnetic valve 17 are intermittently repeated at "a predetermined cycle". The time (duration) of energization or non-energization is determined by a predetermined calculation mentioned later. As a result of the energization control, the valve body is caused to reciprocate between a full open position and a full closed position. The "predetermined cycle" can be set at the cycle responsive to the engine rotational speed or the regular cycle determined in a range of 10 to 100 ms. The electromagnetic valve 17 corresponds to flow regulation means of the invention for regulating the quantity of fuel (the return flow quantity) flowing in the branch passage 15. The relief valve 16 serves to restrict the fuel pressure in the fuel line 3 to a predetermined value.

The jet pump 18 includes a restricted portion 19 for restricting the return flow in the branch passage 15 and a discharge port 20 through which the fuel having passed through the restricted portion 19 is discharged into the reserve tank 9. The second storage chamber 7 and the branch passage 15 at a portion just behind the restricted portion 19 are in communication through a communication passage 21. An end of the communication passage 21 is placed on the bottom of the second storage chamber 7. A suction filter 22 for removing foreign materials is attached to the end of the communication passage 21. The other end (a rear end) of the passage 21 is connected with the branch passage 15 at the portion downstream of the restricted portion 19. Due to the shorter diameter of the restricted portion 19 than that of the branch passage 15, the fuel is increased in flow velocity in passing through the restricted portion 19, consequently producing a negative pressure in the restricted portion 19. By the suction power resulting from this negative pressure, the fuel in the second storage 7 is sucked in the communication passage 21 and transferred into the reserve tank 9 through the discharge port 20 of the jet pump 18. In the present embodiment, the jet pump 18 corresponds to transfer means for transferring the fuel from the second storage chamber 7 to the reserve tank 9 through the communication passage 21 by the action of the fuel flowing through the branch passage 15.

Figure 3:
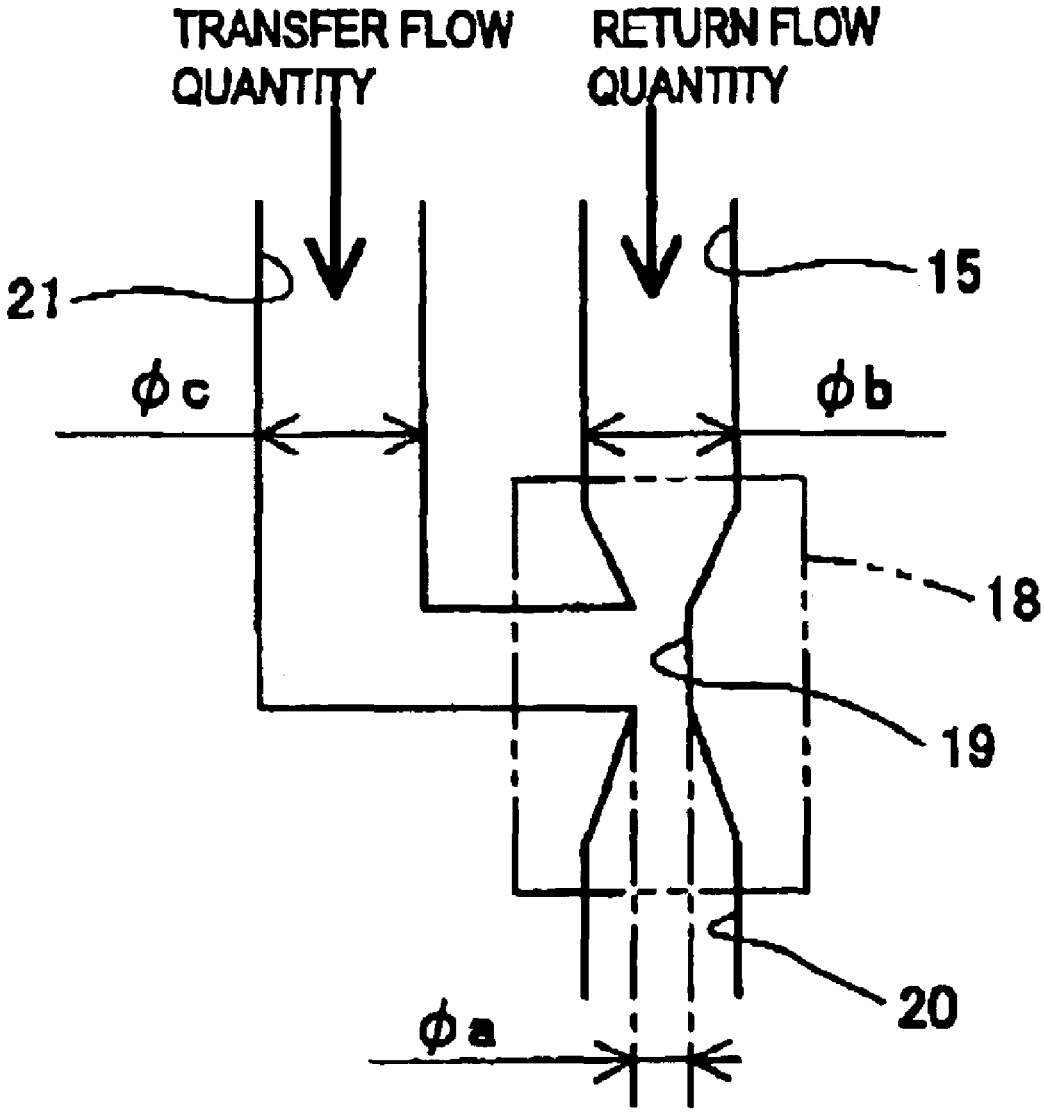
FIG. 3 is a conceptual view of an example of a design specification of a jet pump.

FIG. 3 shows a conceptual view of an example of a design specification related to the jet pump 18. Assuming that the diameter of the restricted portion 19 (the restriction diameter) is "ϕa", the inner diameter of the branch passage 15 for the return flow is "ϕb", and the inner diameter of the communication passage 21 for the transfer flow is "ϕc", these diameters ϕa, ϕb, and ϕc are determined in a predetermined relationship. In the present embodiment, for example, the inner diameter ϕb of the branch passage 15 and the inner diameter ϕc of the communication passage 21 are both set at 4 mm and the restriction diameter ϕa is set at 0.8 mm.

Figure 4:
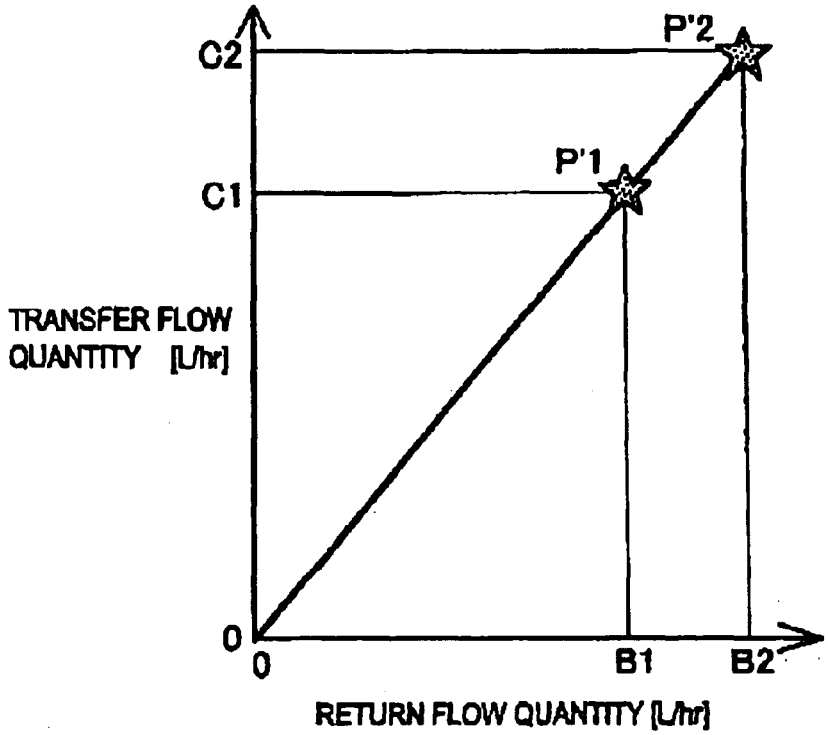
FIG. 4 is a graph showing a relationship between a return flow quantity and transfer flow quantity.
Figure 5:
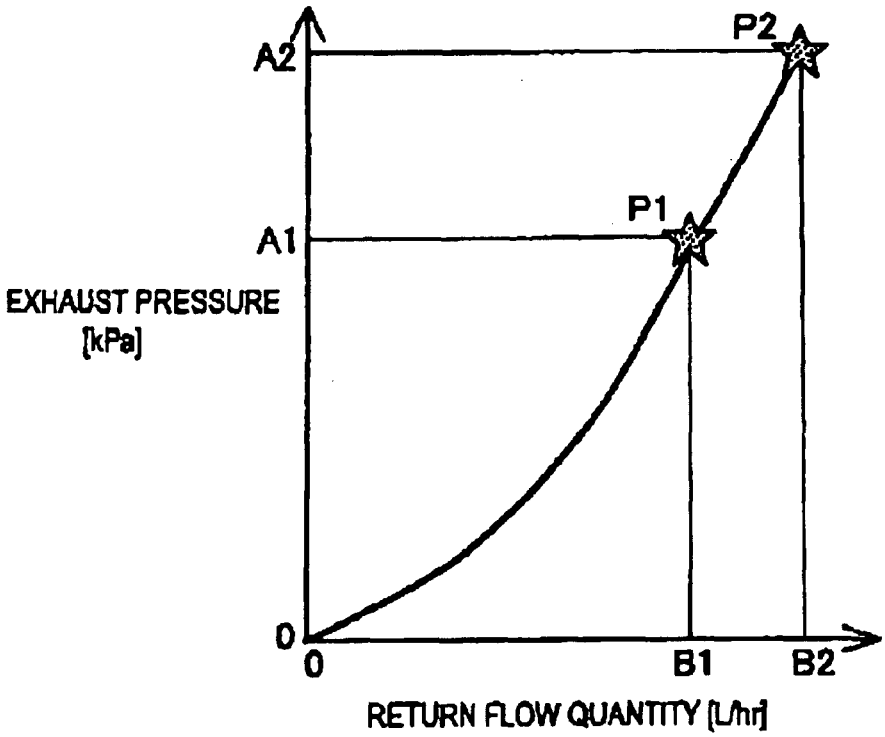
FIG. 5 is a graph showing a relationship between the return flow quantity and exhaust pressure.
Figure 6:
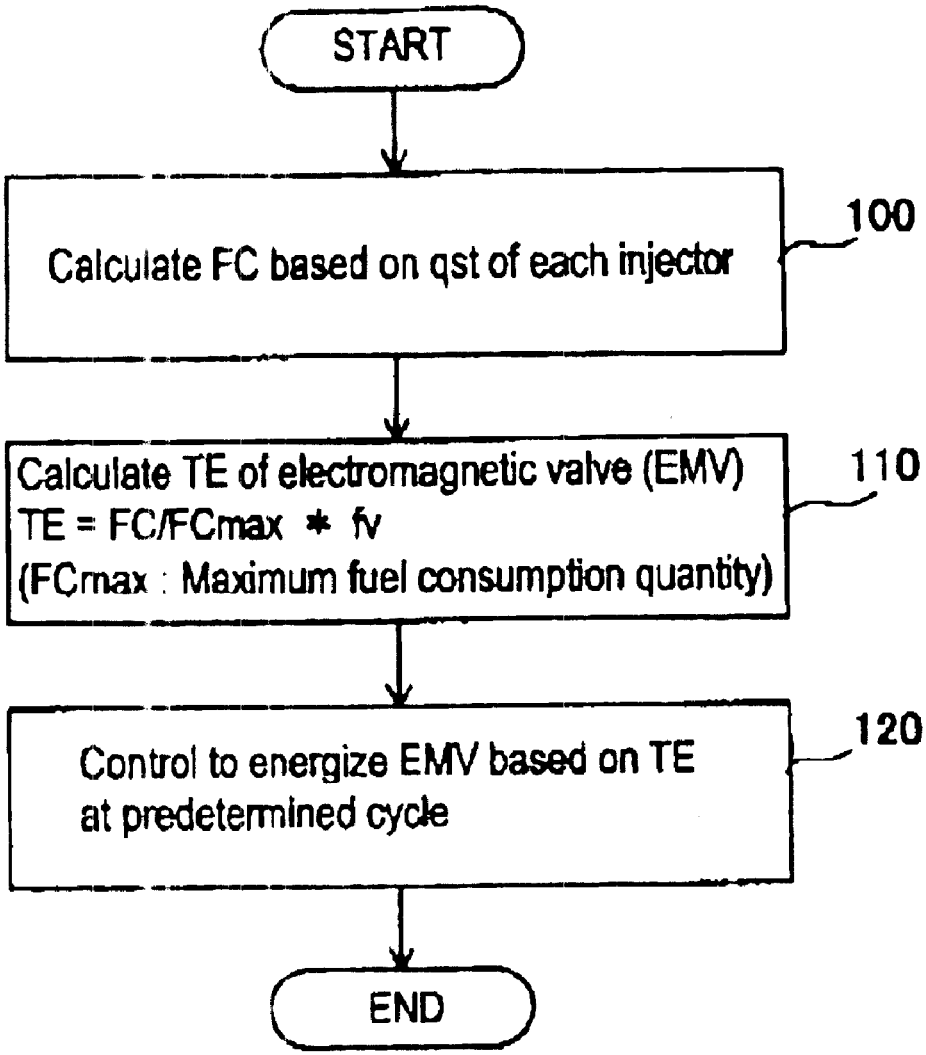
FIG. 6 is a flowchart showing a control program.

The operation of the jet pump 18 is explained below with reference to FIGS. 4 and 6. FIG. 4 is a graph showing a relationship between the quantity of the return flow in the branch passage 16 and the quantity of the transfer flow in the communication passage 21. FIG. 5 is a graph showing a relationship between the above return flow quantity and the exhaust pressure caused in the restricted portion 19.

The driving amount of the fuel pump 2 is controlled based on a detected value (signal) outputted from the fuel pressure sensor 30. This control is executed 80 that the pressure of fuel to be supplied to each injector 14 and so on becomes a predetermined value "A1 or A2 (kPa)". This fuel pressure is exerted on the restricted portion 19 of the jet pump 18 via the electromagnetic valve 17, discharging the fuel toward the discharge port 20 located on the downstream side of the restricted portion 19. This acts as the exhaust pressure in the restricted portion 19. As shown by the point P1 in FIG. 5, accordingly, the return flow quantity reaches B1 (L/hr) when the exhaust pressure is A1 (kPa). At this time, as shown by the point P1' in FIG. 4, the transfer flow quantity in the communication passage 21 becomes C1 (L/hr) for B1 (L/hr). In other words, the fuel is pumped by just C1 (L/hr) from the second storage chamber 7 through the communication passage 21. This pumping operation is continued if the electromagnetic valve 17 is constantly opened or the electromagnetic valve 17 is not placed in the branch passage 15.

In the present embodiment, the electromagnetic valve 17 is controlled to transfer the fuel of a transfer flow quantity corresponding to the consumption quantity FC of fuel to be sequentially consumed in the engine 4, from the second storage chamber 7 to the first storage chamber 6 through the communication passage 21 The electromagnetic valve 17 is thus always operated in the same manner for the fuel pressure P1 shown in FIG. 5. The electromagnetic valve 17 is duty-controlled in the present embodiment. Accordingly, the return flow quantity is set at an intermittent maximum flow quantity, not a mean flow quantity. In the present embodiment, the duty control of the electromagnetic valve 17 is conducted with an allowance of a duty ratio of 20% to 30% in anticipation of errors in the responsivity of the fuel pump 2 and the responsivity of return flow quantity to the opening and closing of the electromagnetic valve 17.

As shown in FIG. 1, the fuel pump 2 and the electromagnetic valve 17 are connected with a controller 40 having a built-in driving circuit. Each injector 14 and the fuel pressure sensor SO are connected with an electronic control unit (ECU) 41. The controller 40 is connected with the ECU 41. Various sensors 31, 32, 83, and 34 are connected with the ECU 41 to detect an operating condition of the engine 4. Specifically, a throttle sensor 81 detects an opening degree (an angle) of a throttle valve (not shown) corresponding to an operating load on the engine 4, a rotational speed sensor 32 detects an engine rotational speed, a water temperature sensor 33 detects a temperature of cooling water in the engine 4, and an intake pressure sensor 34 detects an intake pressure of the engine 4. Based on various signals from those sensors 30 to 34, the ECU 41 executes the fuel injection control, the fuel supply control, and other controls to control each injector 14, the fuel pump 2, and the electromagnetic valve 17. The ECU 41 outputs a driving signal to the controller 40 in order to control the fuel pump 2 and the electromagnetic valve 17. Based on this driving signals the controller 40 drives the fuel pump 2 and the electromagnetic valve 17.

In the present embodiment, the "fuel injection control" is to control the quantity qst of fuel to be injected per one injection from each injector 14 into one associated cylinder by controlling an open time (duration) of each injector 14 according to the operating state of the engine 4. The ECU 41 calculates the quantity qst of fuel to be injected from each injector 14 by the following general expression (1) based on the signals from the various sensors. This fuel flow quantity qst is equivalent to the consumption quantity PC of fuel to be sequentially consumed in the engine 4. The ECU 41 which calculates the fuel consumption quantity FC as above corresponds to the fuel consumption calculation means of the invention.

$$qst=\{Q/(1000*60)\}*\sqrt{\{(Pfs+(Pa-Pm))/Pfo\}}te \quad (1)$$

wherein "Q" represents a fuel flow quantity per unit of time during a valve open time of each injector, "Pfs" represents a fuel pressure (a gauge pressure) during actual use of each injector, "Pa" represents an atmospheric pressure (an absolute pressure), "Pfo" represents a gauge pressure during measurement of the flow characteristic of each injector, and "te" represents an effective energization time of each injector.

The "fuel supply control" is the control of the pressure of the fuel to be discharged by the fuel pump 2 by controlling the fuel pump 2 and the electromagnetic valve 17 through the controller 40 according to the operating state of the engine 4. In this fuel supply control, the ECU 41 calculates the fuel flow quantity to be discharged by the fuel pump 2 in terms of an electric current value to be supplied to the fuel pump 2 to that the pressure of fuel to be supplied to each injector 14 and so on becomes a desired value determined according to the operating state of the engine 4. The ECU 41 calculates the fuel flow quantity based on the signals from the above mentioned sensors.

More specifically, the ECU 41 feedback-controls the fuel pump 2 based on a detected value output from the fuel pressure sensor 30 or detected values output from other sensors 31 to 34 to provide a predetermined fuel pressure. If the quantity qst of fuel flowing into each injector 14 is changed to increase the fuel consumption quantity FC in the engine 4, the fuel pressure decreases for the moment. However, the fuel pressure will return back when the driving amount of the fuel pump 2 is changed based on the detected values from the sensors 30 to 34. The driving amount of the fuel pump 2 thus reflects the fuel consumption quantity FC in the engine 4. The ECU 41, having the information on the above mentioned fuel supply control can find the fuel consumption quantity FC in the engine 4 based on the driving amount of the fuel pump 2, accordingly.

For the fuel supply control, the ECU 41 controls the electromagnetic valve 17 in order to transfer the fuel from the second storage chamber 7 to the reserve tank 9. In the present embodiment, specifically, the ECU 41 controls the electromagnetic valve 17 to transfer the fuel in the quantity qst equivalent to the fuel consumption quantity 7C calculated as above through the communication passage 21. The ECU 41 which executes the above control corresponds to the flow regulation control means of the invention.

Next, the fuel flow regulation control is explained in detail. FIG. 6 is a flowchart of this control program. The ECU 41 periodically executes this routine at predetermined intervals.

In step 100, firstly, the ECU 41 calculates a present fuel consumption quantity FC based on the fuel flow quantity qst to each injector 14 calculated under the fuel injection quantity control. This calculation is made with reference to the following expression (2):

$$FC=qst*N*NE*60/1000/2 \quad (2)$$

wherein "N" represents the number of cylinders "NE" represents an engine rotational speed, "60" is a conversion coefficient from a flow quantity per 'minute' to per 'hour', "1000" is a conversion coefficient from a flow quantity in 'cc' to 'liter', and "2" represents one injection per two rotations.

In step 110, the ECU 41 calculates an energization time (duration) TE of the electromagnetic valve 17 based on the calculated present fuel consumption quantity FC. This calculation is made with reference to the following expression (3):

$$TE=FC/FC\max*fv \quad (3)$$

wherein "FCmax" represents a maximum fuel consumption quantity, and "fv" represents a predetermined cycle of duty control. The maximum fuel consumption quantity FCmax is determined in advance according to the displacement of the engine 4 by the following expression (4):

$$FC\max=(Qa*Ad*NE\max)/(120*Af*Fd) \quad (4)$$

wherein "Qa" represents a maximum intake air quantity, namely, a displacement of the engine 4, "Ad" represents the air density, "NEmax" represents a maximum rotational speed of the engine 4, "Af" represents a demanded air-fuel ratio of the engine 4, "Fd" represents a fuel density, and "120" is a constant number for conversion.

In step 120, the ECU 41 controls energization of the electromagnetic valve 17 (under a duty control) at a predetermined cycle (for example, "1 Hz") based on the calculated present energization time TE, and then terminates the processing for the present.

As described above, in the fuel supply apparatus in the present embodiment, the ECU 41 calculates the fuel consumption quantity FC of fuel to be sequentially consumed in the engine 4. To transfer the fuel of only the calculated fuel consumption quantity FC through the communication passage 21, the ECU 41 controls the electromagnetic valve 17. Thus, the return flow quantity in the branch passage 15 is regulated. In proportion to the regulation, the jet pump 18 regulates the transfer flow quantity of fuel to be transferred from the second storage tank 7 to the reserve tank 9. Accordingly, the transfer flow quantity can be regulated not to exceed the consumption quantity FC of fuel to be sequentially consumed in the engine 4. This makes it possible to prevent the fuel from flowing in an excessive quantity into the reserve tank 9, thereby reducing undulations of the fuel fluid level. Consequently, it is possible to effectively prevent vapors from occurring during transfer of the fuel from the second storage chamber 7 to the reserve tank 9.

[Second embodiment]

Next, a second embodiment of the fuel supply apparatus for an engine according to the present invention will be described below, referring to the accompanying drawings.

It is to be noted that in each of the second and subsequent embodiments, like elements corresponding to those in the first embodiment are indicated by like numerals and their explanations are omitted. The following embodiments are described with a focus on differences from other embodiments.

Figure 7:
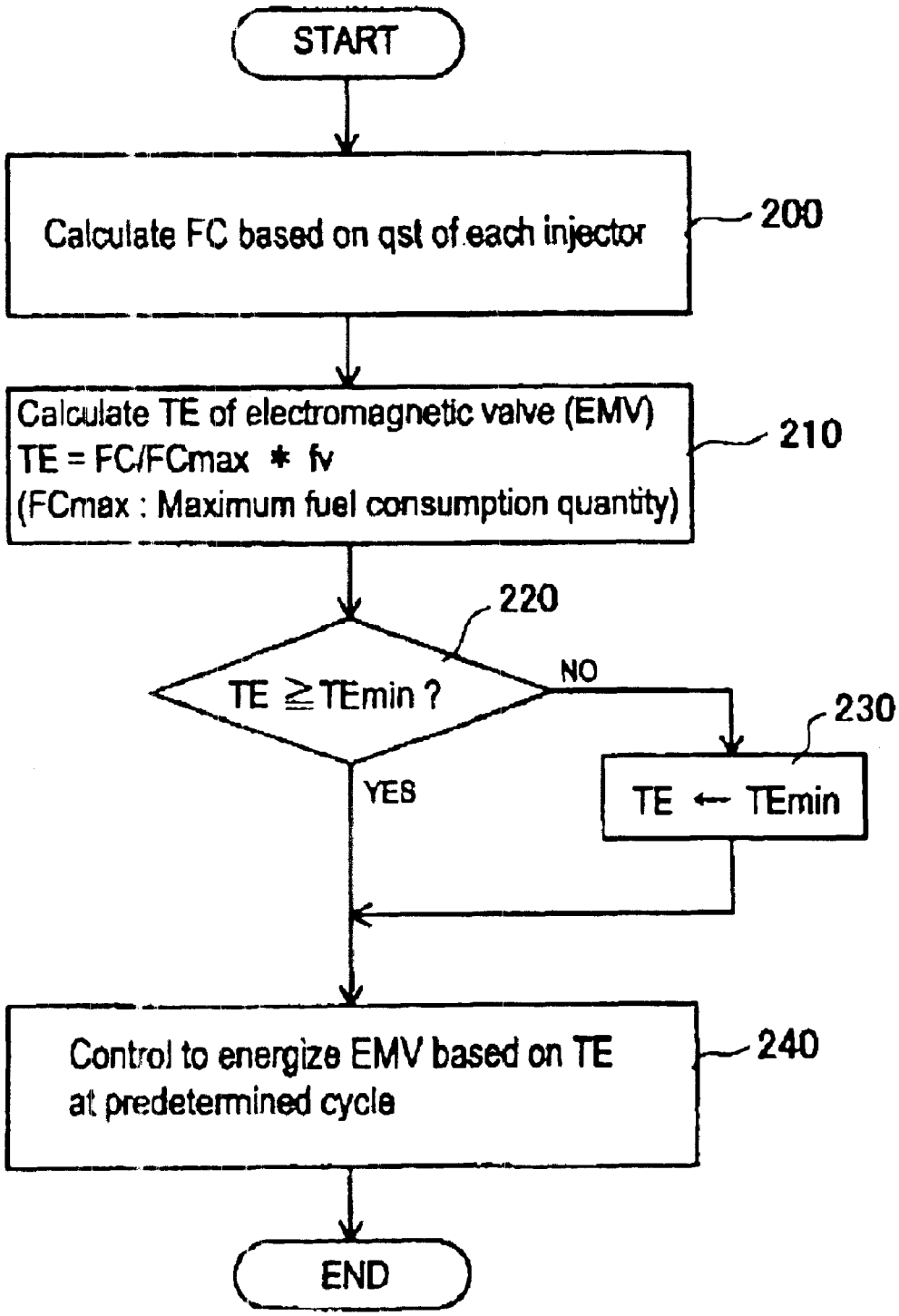
FIG. 7 is a flowchart showing a control program in a second embodiment.

In the second embodiment, the contents of the fuel flow regulation control differs from those in the first embodiment. FIG. 7 is a flowchart showing a control program of the fuel flow regulation control in the second embodiment. The ECU 41 periodically executes this routine at predetermined intervals.

In step 200, firstly, the ECU 41 calculates a present fuel consumption quantity FC based on the fuel flow quantity qst calculated for each injector 14.

In step 210, the ECU 41 calculates an energization time (duration) TE of the electromagnetic valve 17 according to the above expression (3) based on the present fuel consumption quantity FC calculated as above.

In step 220, the ECU 41 determines whether the calculated energization time TE is a lower limit value TEmin of the energization time or more. This lower limit value TEmin may be for example "1 ms". If an affirmative decision is made in this step, the ECU 41 directly advances the flow to step 240. If a negative decision is made, to the contrary, the ECU 41 sets the energization time TE at the lower limit value TEmin in step 230 and advances the flow to step 240. In step 230, specifically, the ECU 41 limits the energization time TE to the lower limit value TEmin to prevent the energization time TE from being shorter than necessary in order to stably and surely operate the electromagnetic valve 17.

In step 240 followed by step 220 or 230, the ECU 41 controls energization of the electromagnetic valve 17 (under a duty control) at a predetermined cycle (for example, "1 Hz") based on the above calculated energization time TE, and terminates the processing for the presents Consequently, the fuel supply apparatus in the second embodiment can provide similar function and effects to those in the first embodiment.

In addition, in the second embodiment, the energization time TE of the electromagnetic valve 17 is limited so as not to become lower than the positive lower limit value TEmin. This makes it possible to provide fuel in a certain stable quantity even when the return flow quantity in the branch passage 15 is reduced Consequently, the fuel can be transferred surely and stably from the second storage chamber 7 to the reserve tank 9.

[Third embodiment]

Next, a third embodiment of the fuel supply apparatus according to the present invention will be described with reference to the accompanying drawings.

Figure 8:
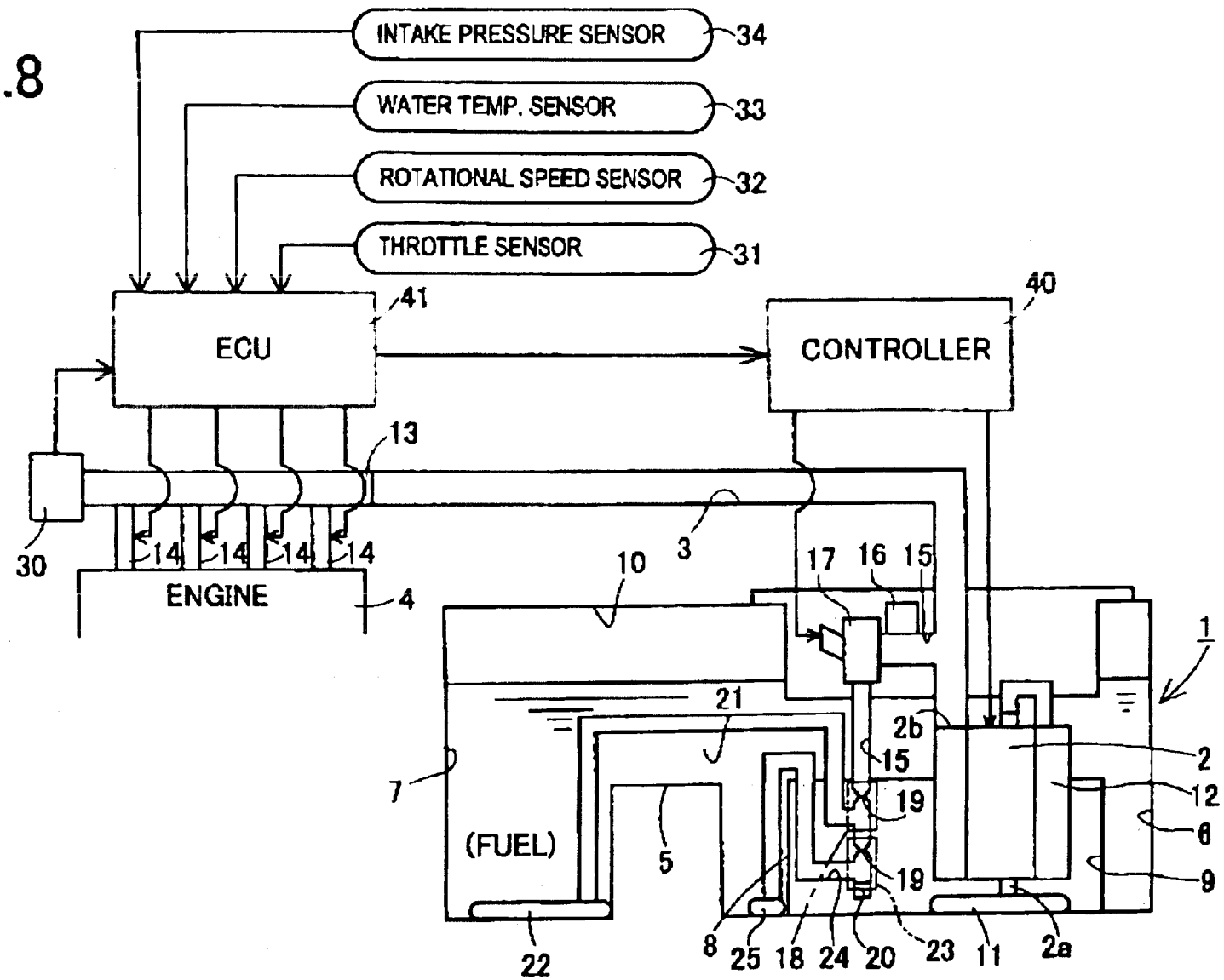
FIG. 8 is a schematic structural view showing a fuel supply apparatus in a third embodiment.

FIG. 8 is a schematic structural view of the fuel supply apparatus in the third embodiment. In this embodiment, in the branch passage 15, there are placed the jet pump 18 and an additional jet pump (hereinafter, referred to as a second jet pump) 23 similarly including a restricted portion 19. The second jet pump 23 is connected with a second communication passage 24 providing communication between the first storage chamber 6 and the branch passage 15. An end of the second communication passage 24 is placed on the bottom of the storage chamber 6 and attached with a suction filter 25. The third embodiment differs in these structures from the first and second embodiments.

Accordingly, the fuel supply apparatus in the third embodiment can provide similar function and effects to those in the first embodiment.

In the third embodiment, furthermore, the fuel can also be transferred from the first storage chamber 6 to the reserve tank 9 through the second communication passage 24 and the second jet pump 23. It is therefore possible to transfer the fuel from both the first and second storage chambers 6 and 7 to the reserve tank 9. As a result, the fuel supply apparatus can cause the fuel pump 2 to efficiently discharge of fuel from the fuel tank 1 to the engine 4.

The present invention may be embodied in other specific forms without departing from the spirit or essential characteristics thereof. For instance, the following modifications may be adopted.

In the above embodiments, the fuel consumption quantity FC is calculated based on the fuel flow quantity qst to each injector 14. Instead, the fuel consumption quantity FC may be calculated based on the driving amount of the fuel pump 2. It is to be noted that the fuel consumption quantity FC can be more precisely determined based on the fuel flow quantity qst to each injector 14 than based on the driving amount of the fuel pump 2. However, the calculation of the fuel consumption quantity FC can be more facilitated by the use of the fuel flow quantity qst.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A fuel supply apparatus comprising:

a fuel tank for storing fuel, including a plurality of storage chambers one of which is a specific storage chamber;

a fuel pump, placed in the specific storage chamber, for discharging the fuel from the fuel tank into a fuel passage which is communicated with an engine, the fuel pump being controlled to regulate pressure of the fuel which is to be supplied to the engine;

a branch passage branching off of the fuel passage, through which branch passage a part of the fuel discharged by the fuel pump is returned to the specific storage chamber;

a communication passage which provides communication between a storage chamber other than the specific storage chamber and the branch passage;

transfer means for transferring the fuel from the storage chamber other than the specific storage chamber to the specific storage chamber through the communication passage by action of the fuel flowing through the branch passage;

flow regulation means for regulating a flow quantity of fuel in the branch passage;

fuel consumption calculation means for calculating a quantity of fuel to be sequentially consumed in the engine; and flow regulation control means for controlling the flow regulation means to transfer fuel in a quantity corresponding to the fuel consumption quantity calculated by the fuel consumption calculation means, from the storage chamber other than the specific storage chamber to the specific storage chamber through the communication passage.

2. The fuel supply apparatus according to claim 1 wherein the transfer means comprises a jet pump including a restricted portion for restricting a flow quantity of fuel in the branch passage and a discharge port through which the fuel having passed through the restricted portion is discharged, the restricted portion being adapted to increase a flow velocity of the fuel passing through the restricted portion, producing a negative pressure in the restricted portion and a consequent suction power, so that the fuel is sucked from the storage chamber other than the specific storage chamber and transferred into the specific chamber through the communication passage and the discharge port.

3. The fuel supply apparatus according to claim 1, wherein the flow regulation means is provided with an electromagnetic valve including a valve body, and the flow regulation control means controls energization of the electromagnetic valve to reciprocate the valve body between a full open position and a full closed position.

4. The fuel supply apparatus according to claim 3, wherein the flow regulation control means calculates an energization time of the electromagnetic valve based on the fuel consumption quantity calculated by the fuel consumption calculation means and, based on the calculated energization time, operates the electromagnetic valve under a duty control at a predetermined cycle.

5. The fuel supply apparatus according to claim 4, wherein the flow regulation control means calculates the energization time (TE) with reference to the following expressions:

$$TE=FC/FC\max*fv,$$

and $$FC\max=(Qa*Ad*NE\max)/(120*Af*Fd),$$

wherein "FCmax" represents a maximum fuel consumption quantity, "fv" represents a predetermined cycle of the duty control "Qa" represents a maximum intake air quantity (a displacement of the engine), "Ad" represents an air density, "NEmax" represents a maximum rotational speed of the engine, "Af" represents a demanded air-fuel ratio of the engine, "Fd" represents a fuel density, and "120" is a constant for conversion.

6. The fuel supply apparatus according to claim 1, wherein the engine includes a plurality of cylinders, the fuel supply apparatus includes injectors for supplying the fuel delivered thereto through the fuel passage, into respective associated cylinders, and the fuel consumption calculation means calculates the fuel consumption quantity (FC) with reference to the is following expressions:

$$qst=\{Q/(1000*60)\}*\sqrt{\{(Pfs+(Pa-Pm))/Pfo\}}*te,$$

and $$FC=qst*N*NE*60/1000/2,$$

wherein "Q" represents a fuel flow quantity per unit of time during a valve open time of each injector, "Pfs" represents a fuel pressure (a gauge pressure) during actual use, "Pa" represents an atmospheric pressure (an absolute pressure), "Pfo" represents a gauge pressure during measurement of a flow characteristic of each injector, "te" represents an effective energization time of each injector, "N" represents the number of cylinders of the engine, "NE" represents a rotational speed of the engine, "60" is a conversion coefficient from a flow quantity per 'minute' to per 'hour', "1000" is a conversion coefficient from a flow quantity in 'cc' to 'liter', and "2" represents one injection from each injector per two rotations of the engine.

7. The fuel supply apparatus according to claim 5, wherein the engine includes a plurality of cylinders, the fuel supply apparatus include injectors for supplying the fuel delivered thereto through the fuel passage, into respective associated cylinders, and the fuel consumption calculation means calculates the fuel consumption quantity (FC) with reference to the following expression:

$$qst=\{Q/(1000*60)\}*\sqrt{\{(Pfs+(Pa-Pm))/Pfo\}}*te,$$

and $$FC=qst*N*NE*60/1000/2,$$

wherein "Q" represents a fuel flow quantity per unit of time during a valve open time of each injector, "Pfs" represents a fuel pressure (a gauge pressure) during actual use, "Pa" represents an atmospheric pressure (an absolute pressure), "Pfo" represents a gauge pressure during measurement of a flow characteristic of each injector, "te" represents an effective energization time of each injector, "N" represents the number of cylinders of the engine, "NE" represents a rotational speed of the engine, "60" is a conversion coefficient from a flow quantity per 'minute' to per 'hour', "1000" is a conversion coefficient from a flow quantity in 'cc' to 'liter', and "2" represents one injection from each injector per two rotations of the engine.

8. The fuel supply apparatus according to claim 1, wherein the flow regulation control means limits a lower limit of a flow quantity to be regulated by the flow regulation means to a predetermined positive value.

9. The fuel supply apparatus according to claim 3, wherein flow regulation control means calculates an energization time of the electromagnetic valve based on the fuel consumption quantity calculated by the fuel consumption calculation means, and limits the calculated energization time to a predetermined lower limit value or more and, based on the limited energization time, operates the electromagnetic valve under a duty control at a predetermined cycle.

10. The fuel supply apparatus according to claim 8, wherein the transfer means comprises a jet pump including a restricted portion for restricting a flow quantity of fuel in the branch passage and a discharge port through which the fuel having passed through the restricted portion is discharged, the restricted portion being adapted to increase a flow velocity of the fuel passing through the restricted portion, producing a negative pressure in the restricted portion and a consequent suction power, so that the fuel is sucked from the storage chamber other than the specific storage chamber and transferred into the specific chamber through the communication passage and the discharge port.

11. The fuel supply apparatus according to claim 8, wherein the flow regulation means is provided with an electromagnetic valve including a valve body, and the flow regulation control means controls energization of the electromagnetic valve to reciprocate the valve body between a full open position and a full closed position.

12. The fuel supply apparatus according to claim 11, wherein the flow regulation control means calculates an energization time of the electromagnetic valve based on the fuel consumption quantity calculated by the fuel consumption calculation means and, based on the calculated energization time, operates the electromagnetic valve under a duty control at a predetermined cycle.

13. The fuel supply apparatus according to claim 12, wherein the flow regulation control means calculates the energization time (TE) with reference to the following expressions:

$$TE=FC/FC\max*fv,$$

and $$Fc\max=(Qa*Ad*NE\max)/(120*Af*Fd),$$

wherein "FCmax" represents a maximum fuel consumption quantity, "fv" represents a predetermined cycle of the duty control, "Qa" represents a maximum intake air quantity (a displacement of the engine), "Ad" represents an air density, "NEmax" represents a maximum rotational speed of the engine, "Af" represents a demanded air-fuel ratio of the engine, "Fd" represents a fuel density, and "120" is a constant for conversion.

14. The fuel supply apparatus according to claim 8, wherein the engine includes a plurality of cylinders, the fuel supply apparatus includes injectors for supplying the fuel delivered thereto through the fuel passage, into respective associated cylinders, and the fuel consumption calculation means calculates the fuel consumption quantity (FC) with reference to the following expressions:

$$qst=\{Q/(1000*60)\}*\sqrt{\{(Pfs+(Pa-Pm))/Pfo\}}*te,$$

and $$FC=qst*N*NE*60/1000/2,$$

wherein "Q" represents a fuel flow quantity per unit of time during a valve open time of each injector, "Pfs" represents a fuel pressure (a gauge pressure) during actual use, "Pa" represents an atmospheric pressure (an absolute pressure), "Pfo" represents a gauge pressure during measurement of a flow characteristic of each injector, "te" represents an effective energization time of each injector, "N" represents the number of cylinders of the engine, "NE" represents a rotational speed of the engine, "60" is a conversion coefficient from a flow quantity per 'minute' to per 'hour', "1000" is a conversion coefficient from a flow quantity in 'cc' to 'liter', and "2" represents one injection from each injector per two rotations of the engine.

15. The fuel supply apparatus according to claim 13, wherein the engine includes a plurality of cylinders, the fuel supply apparatus includes injectors for supplying the fuel delivered thereto through the fuel passage, into respective associated cylinders, and the fuel consumption calculation means calculates the fuel consumption quantity (FC) with reference to the following expressions:

$$qst=\{Q/(1000*60)\}*\sqrt{\{(Pfs+(Pa-Pm))/Pfo\}}*te,$$

and $$FC=qst*N*NE*60/1000/2,$$

wherein "Q" represents a fuel flow quantity per unit of time during a valve open time of each injector, "Pfs" represents a fuel pressure (a gauge pressure) during actual use, "Pa" represents an atmospheric pressure (an absolute pressure), "Pfo" represents a gauge pressure during measurement of a flow characteristic of each injector, "te" represents an effective energization time of each injector, "N" represents the number of cylinders of the engine, "NE" represents a rotational speed of the engine, "60" in a conversion coefficient from a flow quantity per 'minute' to per 'hour', "1000" is a conversion coefficient from a flow quantity in 'cc' to 'liter', and "2" represents one injection from each injector per two rotations of the engine.

16. A fuel supply apparatus comprising:

a fuel tank for storing fuel, including a plurality of storage chambers one of which is a specific storage chamber;

a fuel pump, placed in the specific storage chamber, for discharging the fuel from the fuel tank into a fuel passage which is communicated with an engine including a plurality of cylinders, the fuel pump being controlled to regulate pressure of the fuel which is to be supplied to the engine;

injectors for supplying the fuel, delivered thereto through the fuel passage, into respective associated cylinders;

a branch passage branching off of the fuel passage, through which branch passage a part of the fuel discharged by the fuel pump is returned to the specific storage chamber;

a communication passage which provides communication between a storage chamber other than the specific chamber and the branch passage;

a jet pump for transferring the fuel from the storage chamber other than the specific storage chamber tothe specific storage chamber through the communication passage by action of the fuel flowing through the branch passage, the jet pump including:

a restricted portion for restricting a flow quantity of fuel in the branch passage; and a discharge port through which the fuel having passed through the restricted portion is discharged, the restricted portion being adapted to increase a flow velocity of the fuel passing through the restricted portion, producing a negative pressure in the restricted portion and a consequent suction power, so that the fuel is sucked from the storage chamber other than the specific storage chamber and transferred into the specific chamber through the communication passage and the discharge port;

an electromagnetic valve for regulating the flow quantity of fuel in the branch passage, the electromagnetic valve including a valve body and energization of the electromagnetic valve being controlled to reciprocate the valve body between a full open position and a full closed position;

fuel consumption calculation means for calculating a quantity of fuel to be sequentially consumed in the engine; and flow regulation control means for controlling the flow regulation means to transfer fuel in a quantity corresponding to the fuel consumption quantity calculated by the fuel consumption calculation means, from the storage chamber other than the specific storage chamber to the specific storage chamber through the communication passage, the flow regulation control means calculating an energization time of the electromagnetic valve based on the fuel consumption quantity calculated by the fuel consumption calculation means and, based on the calculated energization time, operates the electromagnetic valve under a duty control at a predetermined cycle.

17. The fuel supply apparatus according to claim 16, wherein the fuel consumption calculation means calculates the fuel consumption is quantity (FC) with reference to the following expressions:

$$qst=\{Q/(1000*60)\}*\sqrt{\{(Pfs+(Pa-Pm))/Pfo\}}*te,$$

and $$FC=qst*N*NE*60/1000/2,$$

wherein "Q" represents a fuel flow quantity per unit of time at a valve open time of each injector, "Pfs" represents a fuel pressure (a gauge pressure) during actual use, "Pa" represents an atmospheric pressure (an absolute pressure), "Pfo" represents a gauge pressure during measurement of flow characteristics of each injector, "te" represents an effective energization time of each injector, "N" represents the number of cylinders of the engine, "NE" represents a rotational speed of the engine, "60" is a conversion coefficient from a flow quantity per 'minute' to per 'hour', "1000" is a conversion coefficient from a flow quantity in 'cc' to 'liter', and "2" represents one injection from each injector per two rotations of the engine.

18. The fuel supply apparatus according to claim 16, wherein the flow regulation control means calculates the energization time (TE) with reference to the following expressions:

$$TE=FC/FC\max*fv;$$

and $$FC\max=(Qa*Ad*NE\max)/(120*Af*Fd),$$

wherein "FCmax" represents a maximum fuel consumption quantity, "fv" represents a predetermined cycle of the duty control, "Qa" represents a maximum intake air quantity (a displacement of the engine), "Ad" represents an air density, "NEmax" represents a maximum rotational speed of the engine, "Af" represents a demanded air-fuel ratio of the engine, "Fd" represents a fuel density, and "120" is a constant for conversion.

19. The fuel supply apparatus according to claim 17, wherein the flow regulation control means calculates the energization time (TE) with reference to the following expressions:

$$TE=FC/FC\max*fv;$$

and $$FC\max=(Qa*Ad*NE\max)/(120*Af*Fd),$$

wherein "FCmax" represents a maximum fuel consumption quantity, "fv" represents a predetermined cycle of the duty control, "Qa" represents a maximum intake air quantity (a displacement of the engine), "Ad" represents an air density, "NEmax" represents a maximum rotational speed of the engine, "Af" represents a demanded air-fuel ratio of the engine, "Fd" represents a fuel density, and "120" is a constant for conversion.

20. The fuel supply apparatus according to claim 16, wherein flow regulation control means calculates an energization time of the electromagnetic valve based on the fuel consumption quantity calculated by the fuel consumption calculation means, and limits the calculated energization time to a predetermined lower limit value or more and, based on the limited energization time, operates the electromagnetic valve under a duty control at a predetermined cycle.

* * * * *